US007249862B2

(12) United States Patent
Shirane

(10) Patent No.: US 7,249,862 B2
(45) Date of Patent: Jul. 31, 2007

(54) POWER TOOL WITH ADDITIONAL FUNCTION

(75) Inventor: Takayuki Shirane, Moriguchi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 29 days.

(21) Appl. No.: 10/514,749

(22) PCT Filed: Apr. 24, 2003

(86) PCT No.: PCT/JP03/05313

§ 371 (c)(1),
(2), (4) Date: Nov. 18, 2004

(87) PCT Pub. No.: WO03/097306

PCT Pub. Date: Nov. 27, 2003

(65) Prior Publication Data

US 2005/0152131 A1 Jul. 14, 2005

(30) Foreign Application Priority Data

May 20, 2002 (JP) ..... 2002-144238

(51) Int. Cl.
*B25B 23/18* (2006.01)

(52) U.S. Cl. ..... 362/119; 362/109; 362/190; 362/197; 362/198

(58) Field of Classification Search ..... 362/119, 362/109, 190, 197, 198; 307/18, 85, 150
See application file for complete search history.

(56) References Cited

U.S. PATENT DOCUMENTS 6,007,940 A 12/1999 Spotnitz
6,106,971 A 8/2000 Spotnitz
6,273,582 B1 * 8/2001 Taggart et al. ..... 362/119
6,373,152 B1 * 4/2002 Wang et al. ..... 307/150
6,427,070 B1 7/2002 Smith
6,496,688 B2 12/2002 Smith
6,502,949 B1 * 1/2003 Horiyama et al. ..... 362/119
2002/0033267 A1 3/2002 Schweizer et al.

FOREIGN PATENT DOCUMENTS

JP SHO 60-149779 10/1985
JP 3-79279 8/1991
JP 6-141474 A 5/1994
JP 07-161340 6/1995
JP 9-047982 2/1997

(Continued)

OTHER PUBLICATIONS

Korean Office Action issued in corresponding Korean Patent Application, dated Jul. 11, 2006.

*Primary Examiner*—Ali Alavi
*Assistant Examiner*—Mark Tsidulko
(74) *Attorney, Agent, or Firm*—McDermott Will & Emery LLP

(57) ABSTRACT

The present invention provides an electric tool which includes an electrical device, such as a radio, as an additional function, and is lightweight and easy to handle for operation. The electric tool includes a lithium-ion secondary battery as a power supply, and is equipped with an electrical device, which operates on small electric power supplied from the lithium-ion secondary battery.

7 Claims, 7 Drawing Sheets

FOREIGN PATENT DOCUMENTS

| | | | |
|---|---|---|---|
| JP | 11-221783 | | 8/1999 |
| JP | 2000-308980 | A | 7/2000 |
| JP | 2001-300867 | A | 10/2001 |
| KR | 1998-061367 | A | 11/1998 |
| KR | 2000-0073516 | | 12/2000 |

* cited by examiner

POWER TOOL WITH ADDITIONAL FUNCTION

TECHNICAL FIELD

The present invention relates to electric tools, such as electric drivers for use in screw fastening work.

BACKGROUND ART

Electric tools, such as electric drivers, for use in the screw fastening work have hitherto been used primarily in construction sites and the like for business purposes as they permit significant improvement in operative efficiency. In recent years, they are available at home improvement centers and the like, and have come to be generally used for home carpentry.

In home carpentry, the price of an electric tool per one operation is expensive because of a low frequency of the use thereof. Thus, electric tools have been required to provide some sort of added value. Moreover, since portable radios are often brought into working operation sites, there have been proposed configurations in which a radio is added to a charger for charging a battery of an electric tool (e.g. Japanese Laid-Open Patent Publication No. 2000-92726: corresponding U.S. Pat. No. 6,427,070 and U.S. Pat. No. 6,496,688). However, in operation sites used by operation workers, commercial power supplies are often not prepared. Further, it is often the case that a customer having ordered working operations bears electrical expenses thereof. For these reasons, in many cases, spare batteries are prepared in working operation sites and batteries are not charged. It is therefore necessary to add some sort of value not to a charger, but to an electric tool itself.

Since a person holds an electric tool with his hand while at work, however, it needs to-be light enough for portability. This has made it impossible to add an additional function which would cause a weight increase of an electric tool.

DISCLOSURE OF INVENTION

In view of the aforesaid conventional problem, an object of the present invention is to provide an electric tool which is lightweight and easy to handle for operation, even with an addition function added thereto.

For the purpose of achieving the above object, an electric tool equipped with an additional function in accordance with the present invention is one comprising a lithium-ion secondary battery as a power supply, characterized in that the electric tool is equipped with an electrical device as an additional function, which operates on small electric power supplied from the lithium-ion secondary battery.

Since lithium-ion secondary batteries are lighter than nickel-cadmium storage batteries and nickel-metal hydride storage batteries, which have conventionally been used for electric tools, it is possible to equip a lithium-ion secondary battery with an additional function having a weight corresponding to a weight difference between either of the aforesaid two sorts of storage batteries and a lithium-ion secondary battery. For example, ten nickel-metal hydride storage batteries of sub-C size, having a total weight of 550 g, are used in an electric driver. When these batteries are replaced with lithium-ion secondary batteries, eight lithium-ion secondary batteries of 18650 size are sufficient to obtain the equivalent total battery electric power. In this case, the total weight is 320 g, with a 200-g weight margin.

Further, according to the present invention, since the additional function operates on small electric power, the electric power of the battery as the power supply is not consumed so much. Also, there is a disadvantage peculiar to lithium-ion secondary batteries. The disadvantage is that, when a lithium-ion secondary batter is stored in a fully charged state, i.e., when the power of a fully charged lithium-ion secondary battery is not consumed, the battery will deteriorate specifically. However, in the case of the electric tool equipped with an additional function in accordance with the present invention, even when the electric tool is not used, the additional function consumes the power of the battery, thereby producing the effect of preventing the disadvantage.

Furthermore, it is preferable that the electrical device continue to consume small electric power supplied from the lithium-ion secondary battery when the electrical device is electrically connected to the lithium-ion secondary battery. This can be exemplified by electrical devices, such as clocks, assumed to usually keep operating and thus keep consuming small electric power. Another preferable example may be electrical devices, such as radios, that keep consuming small electric power through a quiescent current or the like even when they are switched off. The continuous consumption of the battery electric power by the electrical device results in more certain generation of the effect of inhibiting the disadvantage of specific deterioration of the lithium-ion secondary battery during storage in a fully charged state.

It is further preferable that the lithium-ion secondary battery be included in a battery pack, and that the electrical device be installed integrally in the battery pack. This configuration of integrating the electrical device and the lithium-ion secondary battery with the battery pack enables continuous consumption of battery electric power by the electrical device, even with the battery pack (lithium-ion secondary battery) removed from the main body of the electric tool, and it is thereby possible to continuously generate the effect of inhibiting the disadvantage of specific deterioration of the lithium-ion secondary battery during storage in a sully charged state.

A brief description will be given of the specific deterioration of lithium-ion secondary batteries. Lithium-ion secondary batteries often cause the following phenomenon as their general properties: when the battery is stored at a high temperature, an active material reacts with an electrolyte to form a coating film on the active material surface of the battery, or gas is generated through the reaction to cause expansion of the battery.

This phenomenon is related to the depth of battery charge, the temperature at which the battery is allowed to stand, and the time for which the battery is allowed to stand. Specifically, the larger the depth of the battery charge, or the higher the temperature at which the battery is allowed to stand, or the longer the time for which the battery is allowed to stand at a high temperature, the more markedly the phenomenon occurs. When a battery is allowed to stand in a fully charged state at 40 to 50° C. for about a week, for example, deterioration in discharge characteristic of the battery associated with the formation of a coating film, and deterioration in discharge characteristic and cycle life characteristic due to the battery expansion, are markedly observed.

In the present invention, this phenomenon has been described as specific deterioration. According to the present invention, it is possible to prevent the specific deterioration from occurring even in the case where the electric tool is allowed to stand in a high-temperature atmosphere at about 40 to 70° C. for a long period of time.

It is also preferable that the electric tool be an electric driver. An electric driver is often carried with a person by means of a portable belt even during a working operation not using the electric driver, and hence has an advantage of making an additional function well utilized.

It is also preferable that the electrical device comprise at least one of a radio, clock and light. It is further preferable that the electrical device comprise a display unit, and in particular that the display unit comprise at least one of a function of displaying the remaining power of a battery, and a clock function.

These electrical devices are in regular use in working operation sites and at homes, and therefore highly convenient as additional functions for users of electric tools. Further, the installation of these electrical devices in electric tools as additional functions can generate the effect of allowing users of those electric tools to handle the electric tools carefully. Moreover, it is particularly favorable to install a display unit having a function of displaying the remaining power of a battery, since this makes it possible to predict when the battery needs to be replaced.

BEST MODE FOR CARRYING OUT THE INVENTION

In the following, embodiments of the present invention will be described in detail based on specific examples, using attached drawings.

EMBODIMENT 1

Figure 1:
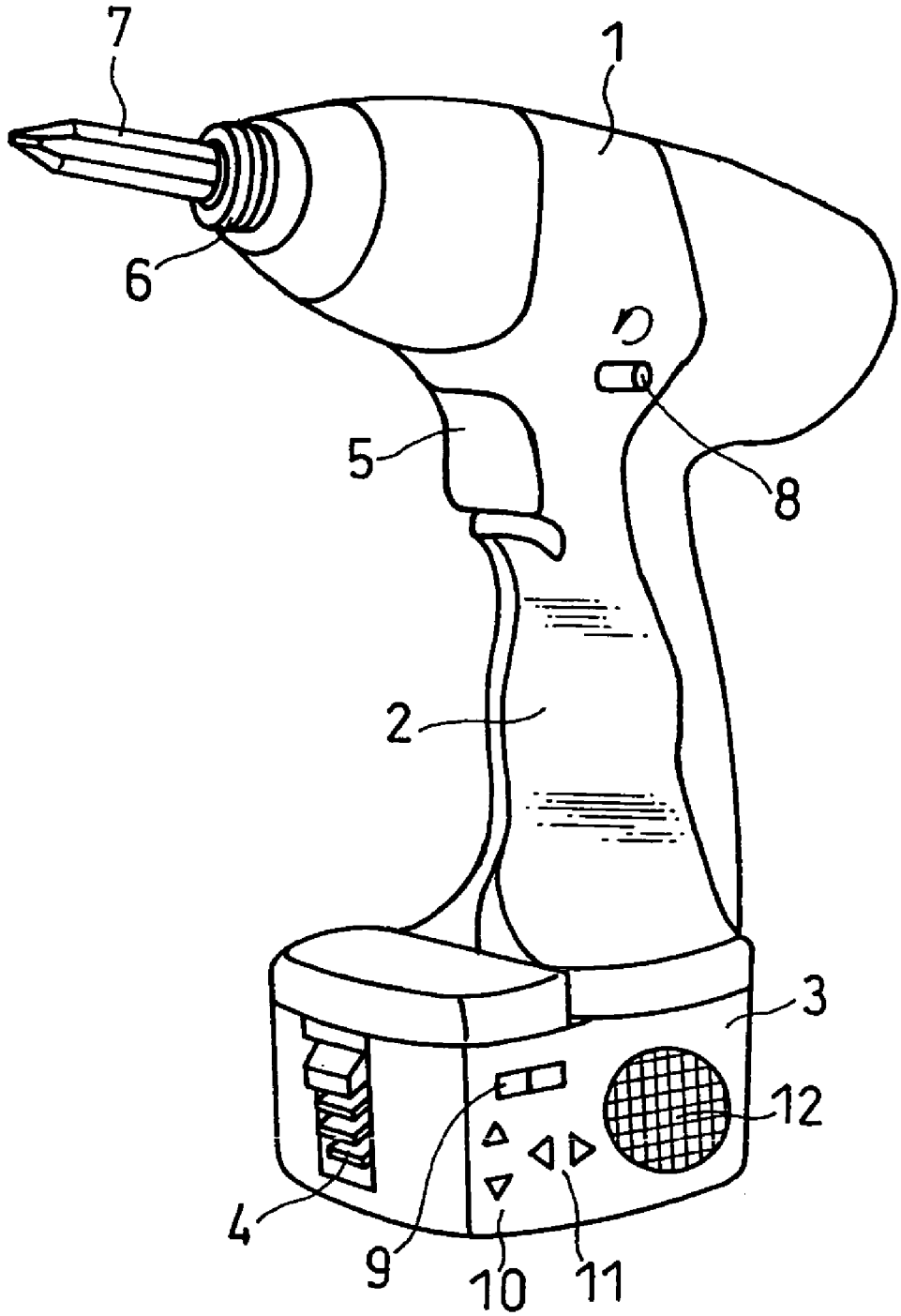
FIG. 1 is a schematic oblique view of an electric driver equipped with a radio, in accordance with Embodiment 1 of the present invention.

FIG. 1 shows a schematic oblique view of an electric driver equipped with a radio based on Embodiment 1 of the present invention. A housing 1 with a rotation drive built therein is provided with a handle 2. A battery pack 3 is provided on the end of the handle 2, which engages a latch 4. The handle 2 is also provided with a switch trigger 5, and while triggering the switch trigger 5, a driver bit 7 which is fixed by a one-touch holder 6 can be rotated. The rotating direction at this time can be varied by a push button 8.

In the present embodiment, in addition to the lithium-ion secondary battery, a radio circuit is housed in the battery pack 3, and the side surface of the battery pack 3 is provided with a power-on switch 9, a volume switch 10, and a tuner switch 11, of the radio. When the power-on switch 9 is turned on and then the volume switch 10 and the tuner switch are suitably adjusted, a sound comes from a speaker 12.

Simultaneously, small electric power supplied from the lithium-ion secondary battery is consumed by the use of this radio, even when the electric driver is not in use, thereby enabling inhibition of the disadvantage of specific deterioration of the lithium-ion secondary battery during storage in a fully charged state.

In the present embodiment, since the battery pack 3 is added with a radio, the radio is usable even when removed from the electric driver main body. In other words, the radio can consume small electric power supplied from the lithium-ion secondary battery even when the battery pack 3 has been removed from the electric driver main body. This can inhibit the disadvantage of specific deterioration of the lithium-ion secondary battery during storage in a fully charged state.

In the present embodiment, the electric tool, the lithium-ion secondary battery and an additional function portion comprising the electrical device are suitably connected electrically in the electric tool equipped with an additional function. One of the examples thereof will be described below, using FIG. 5.

Figure 5:
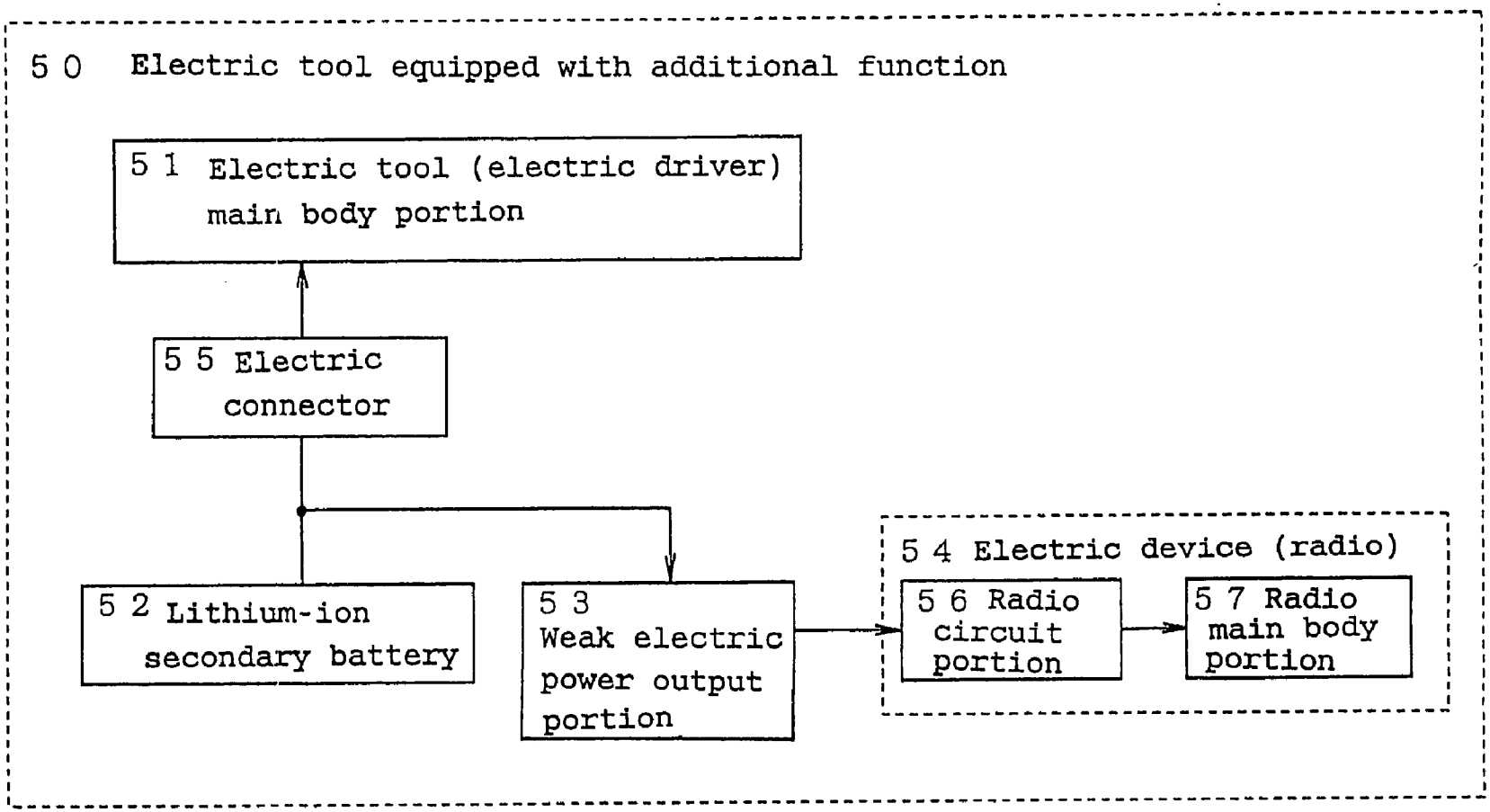
FIG. 5 is a schematic block diagram representing a constitutional example of electrical connection of an electric tool equipped with an additional function in each Embodiment.

FIG. 5 is a schematic block diagram representing a constitutional example of electrical connection of an electric tool (electric driver) 50 equipped with an additional function in accordance with the present embodiment (and also applicable to the other embodiments). In FIG. 5, the electric tool 50 equipped with an additional function comprises an electric tool (electric driver) main body portion 51, and a lithium-ion secondary battery portion 52 that is electrically connected to the electric tool main body portion 51, and for supplying electric power to the electric tool main body portion 51. The electric tool 50 equipped with an additional function further comprises an additional function portion which comprises: (1) a small electric power output portion 53 that is electrically connected to the lithium-ion secondary battery portion 52, and for outputting small electric power on reception of electric power from the lithium-ion secondary battery; and (2) an electrical device (radio) 54 that is electrically connected to the small electric power output portion 53 and electrically driven by small electric power supplied from the small electric power output portion 53. The electrical device (radio) 54 comprises a radio circuit portion 56 driven by small electric power supplied from the small electric power output portion 53, and a radio main body portion 57 (a speaker 12 etc.) connected to the radio circuit portion 56.

At the midway point of an electrical connection wire between the electric tool main body portion 51 and the lithium-ion secondary battery 52, an electric connector 55 is provided if required. This permits such a configuration that the lithium-ion secondary battery 52, or a battery pack containing the lithium-ion secondary battery 52, the small electric power output portion 53 and the electrical device (radio), can be removed from the electric tool main body portion 51 to be used as a radio.

It is preferable in the present embodiment in the case where the radio is electrically connected to the lithium-ion secondary battery that the radio consume small electric power supplied from the lithium-ion secondary battery through a quiescent current even when switched off. This is because such consumption of small electric power can certainly inhibit the disadvantage of specific deterioration of the lithium-ion secondary battery during storage in a fully charged state.

In FIG. 5 and the present embodiment, it is assumed that the electrical device 54 is a radio. However, this constitutional example of FIG. 5 is not limited to the present embodiment, but in common with other Embodiments 2 to 4 as later described. In the present embodiment, a radio is used as the electrical device; however, in Embodiments 2 to 4, a clock, a light and a display unit (e.g. a display of the remaining power of a battery, and a clock display) are used respectively as the electrical device in place of the radio. Except that, the same configuration to that in FIG. 5 as well as the present embodiment is applied.

Further, a radio circuit portion 56 and a speaker are operated on small electric power supplied from the lithium-ion secondary battery. This small electric power is in an amount ignorable as compared with electric power required for the rotation drive of the electric driver main body. Moreover, the lithium-ion secondary battery within the battery pack 3 is charged when its amount of electricity has decreased to a certain degree in order to normally drive the rotation drive. This can produce the following effect: For example, in the case where a radio including a battery as an independent power source is not electrically connected to the battery pack 3, but simply installed therein mechanically, there are problems in that the battery is dead when a person wants to listen to the radio, or in that it takes all the trouble to replace the power supply just for listening to the radio. As opposed to this, the present embodiment has the effect of eliminating such problems.

It should be noted that the radio is installed in the battery pack 3 in the present embodiment. It is thereby possible, as thus described, to obtain the effect generated by the integration of the lithium-ion secondary battery with the radio even when the battery pack has been removed from the electric driver main body. When such an effect is not required, however, the radio may be installed in the electric driver main body, such as the housing 1.

EMBODIMENT 2

Figure 2:
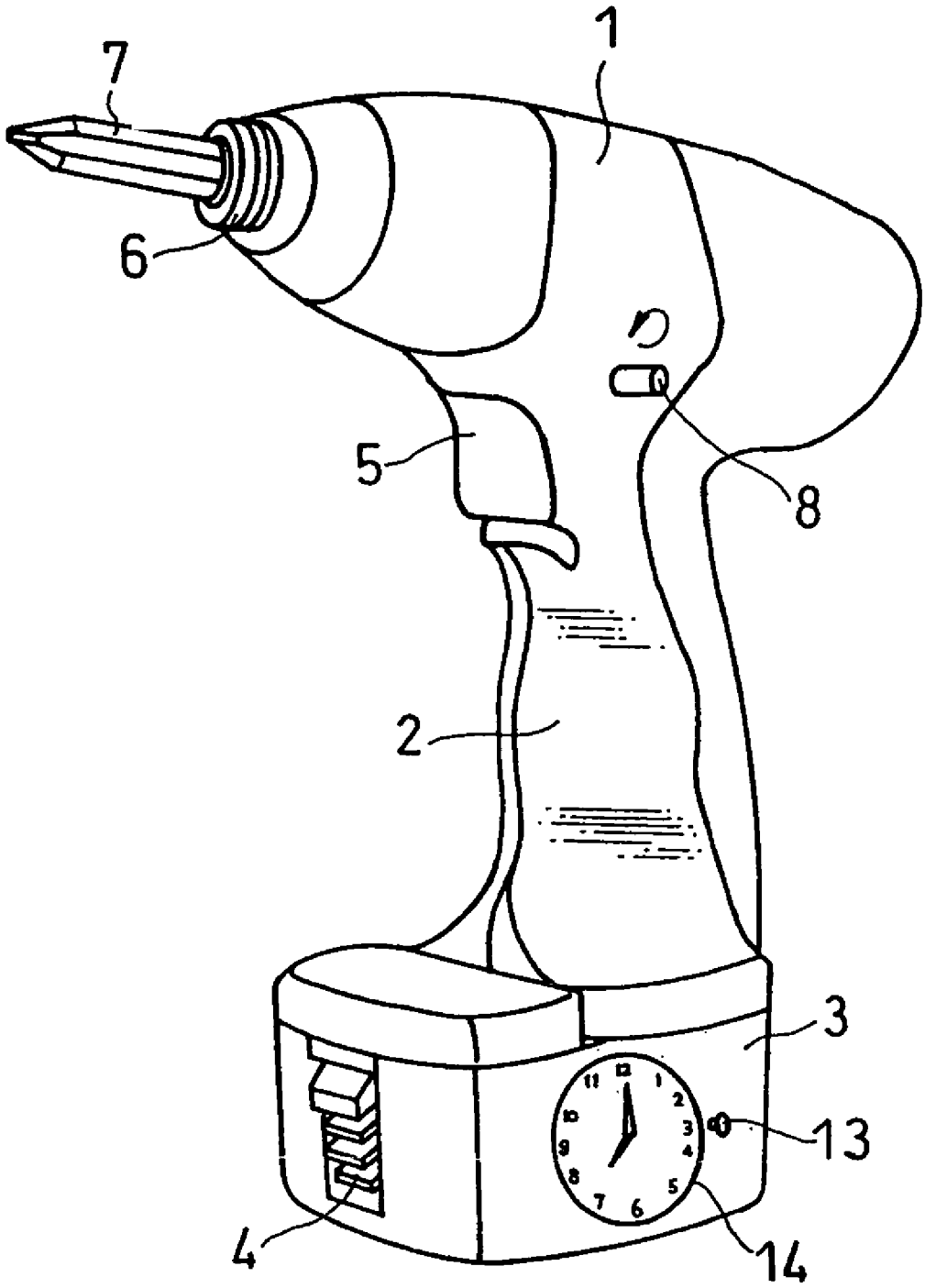
FIG. 2 is a schematic oblique view of an electric driver equipped with a clock, in accordance with Embodiment 2 of the present invention.

FIG. 2 shows a schematic oblique view of an electric driver equipped with a clock in accordance with Embodiment 2 of the present invention. In FIG. 2, elements with the same numeral signals as those elements in FIG. 1 have the same names and functions as those elements in FIG. 1.

In the present embodiment, in addition to the lithium-ion secondary battery, a clock-driving circuit is housed in the battery pack 3, and the side surface of the battery pack 3 is provided with a clock (electrical device) 14. This indicates the time.

This clock at the same time enables inhibition of the disadvantage of specific deterioration of the lithium-ion secondary battery during storage in a fully charged state, even when the electric driver is not used.

Figure 6:
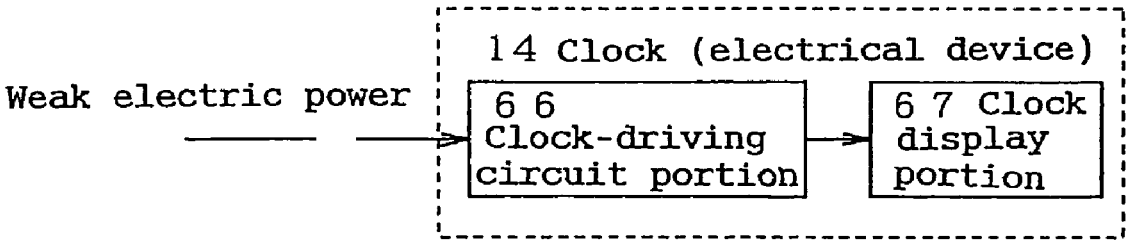
FIG. 6 is a schematic block diagram representing an example of a clock as an electrical device, in accordance with Embodiment 2 of the present invention.

A constitutional example of electrical connection of an electric driver equipped with a clock based on the present embodiment is one obtained by replacing the electrical device (radio) 54 in FIG. 5 with a clock 14 as shown in the schematic block diagram in FIG. 6. Weak current power output in FIG. 6 corresponds to output from the small electric power output portion 53 in FIG. 5. In FIG. 6, the clock 14 comprises a clock-driving circuit portion 66 that is driven by small electric power from the lithium-ion secondary battery, and a clock display unit 67.

In the present embodiment, since the battery pack 3 is added with a clock 14, the clock 14 can be used after the battery pack 3 is removed from the electric driver main body portion (electric tool main body portion). In other words, the clock can consume small electric power supplied from the lithium-ion secondary battery even when the battery pack 3 has been removed from the electric driver main body. This can inhibit the disadvantage of specific deterioration of the lithium-ion secondary battery during storage in a fully charged state.

Further, small electric power supplied from the lithium-ion secondary battery, operating the clock-driving circuit, is in an amount ignorable as compared with electric power required for the rotation drive of the electric driver main body. Moreover, the lithium-ion secondary battery within the battery pack 3 is charged when its amount of electricity has decreased to a certain degree in order to normally drive the rotation drive. This can produce the following effect: For example, in the case where a clock including a battery as an independent power source is not electrically connected to the battery pack 3, but simply installed therein mechanically, there are problems in that the battery abruptly goes dead, or in that it takes all the trouble to replace the power supply just for activating the clock. As opposed to this, the present embodiment has the effect of eliminating such problems.

It should be noted that the clock is installed in the battery pack 3 in the present embodiment. It is thereby possible, as thus described, to obtain the effect generated by the integration of the lithium-ion secondary battery with the clock even when the battery pack has been removed from the electric driver main body. When such an effect is not required, however, the clock may be installed in the electric driver main body, such as the housing 1.

EMBODIMENT 3

Figure 3:
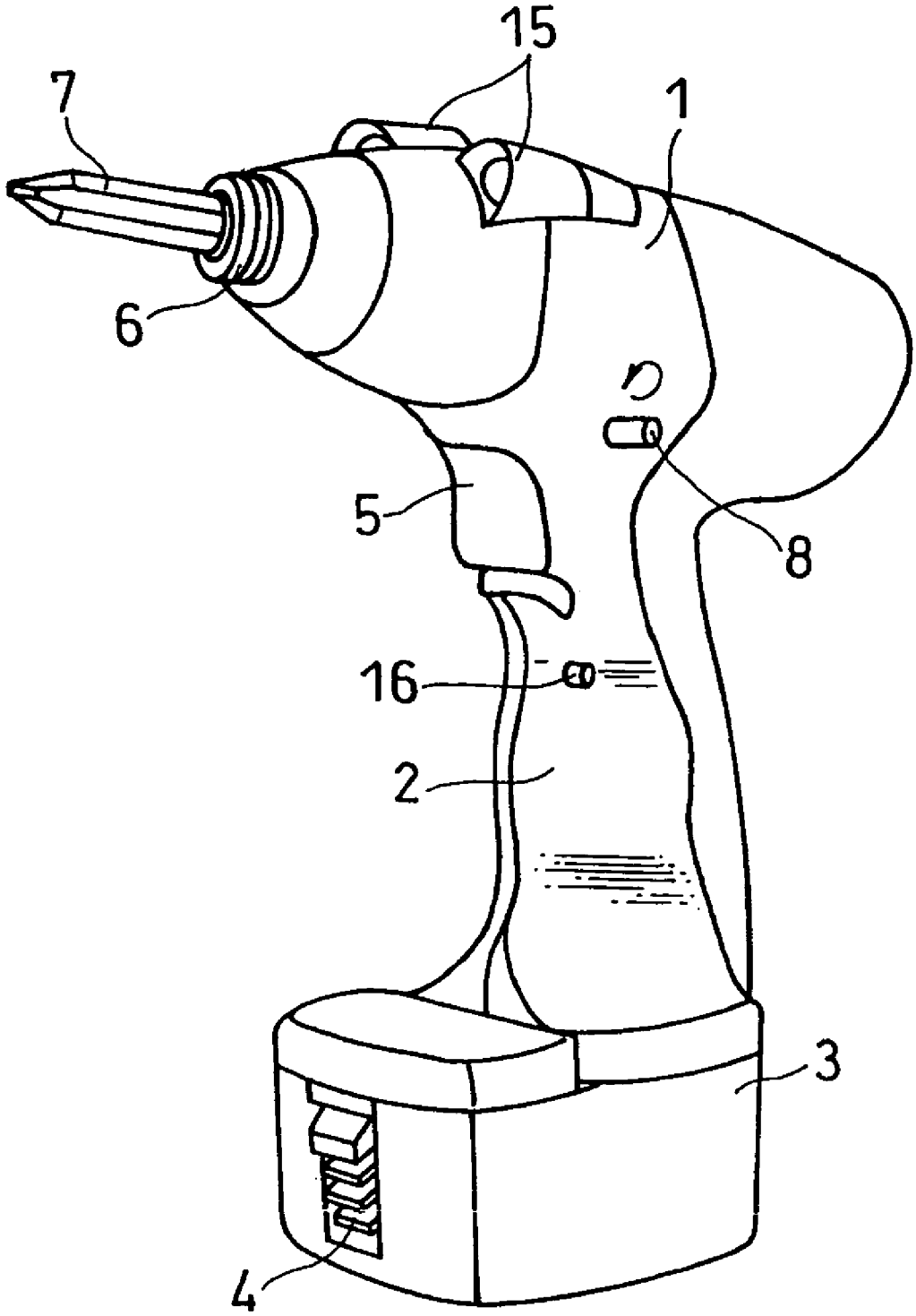
FIG. 3 is a schematic oblique view of an electric driver equipped with a light, in accordance with Embodiment 3 of the present invention.

FIG. 3 shows a schematic oblique view of an electric driver equipped with a light in accordance with an embodiment of the present invention. In FIG. 3, elements with the same numeral signals as those elements in FIG. 1 have the same names and functions as those elements in FIG. 1.

In the present embodiment, the housing 1 is provided with a light (electrical device) 15 whose power supply is the lithium-ion secondary battery, and the handle 2 is added with a light switch 16. This configuration allows this light to be used like a flashlight. When a person works at a dark place, for example, under an automobile, the person can shine light on necessary places such as screws, so that the person can see the places clearly.

The use of this light at the same time enables inhibition of the disadvantage of specific deterioration of the lithium-ion secondary battery during storage in a fully charged state, even when the electric driver is not used.

Figure 7:
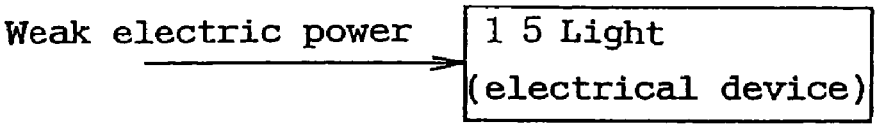
FIG. 7 is a schematic block diagram representing an example of a light as an electrical device, in accordance with Embodiment 3 of the present invention.

A constitutional example of electrical connection of an electric driver equipped with a light based on the present embodiment is one obtained by replacing the electrical device (radio) 54 in FIG. 5 with a light 15 as shown in the schematic block diagram in FIG. 7. Weak current power output in FIG. 7 corresponds to output from the small electric power output portion 53 in FIG. 5.

The light 15 operates on small electric power supplied from the lithium-ion secondary battery. This small electric power is in an amount ignorable as compared with electric power required for the rotation drive of the electric driver main body. Moreover, the lithium-ion secondary battery within the battery pack 3 is charged when its amount of electricity has decreased to a certain degree in order to normally drive the rotation drive. This can produce the following effect: For example, in the case where a light including a battery as an independent power source is not electrically connected to the battery pack 3, but simply installed therein mechanically, there are problems in that the power abruptly goes dead, or in that it takes all the trouble to replace the power supply just for turning on the light. As opposed to this, the present embodiment has the effect of eliminating such problems.

It should be noted that, in the present embodiment, two lights 15 are installed in the upper part of the housing 1; however, only one light may be applied, or a plurality of lights may be installed on the side of the housing 1. The light 15 can also be installed integrally on the side surface of the battery pack 3. Therefore, the light can consume small electric power supplied from the lithium-ion secondary battery even when the battery pack 3 has been removed from the electric driver main body, thereby enabling inhibition of the disadvantage of specific deterioration of the lithium-ion secondary battery during storage in a fully charged state.

EMBODIMENT 4

Figure 4:
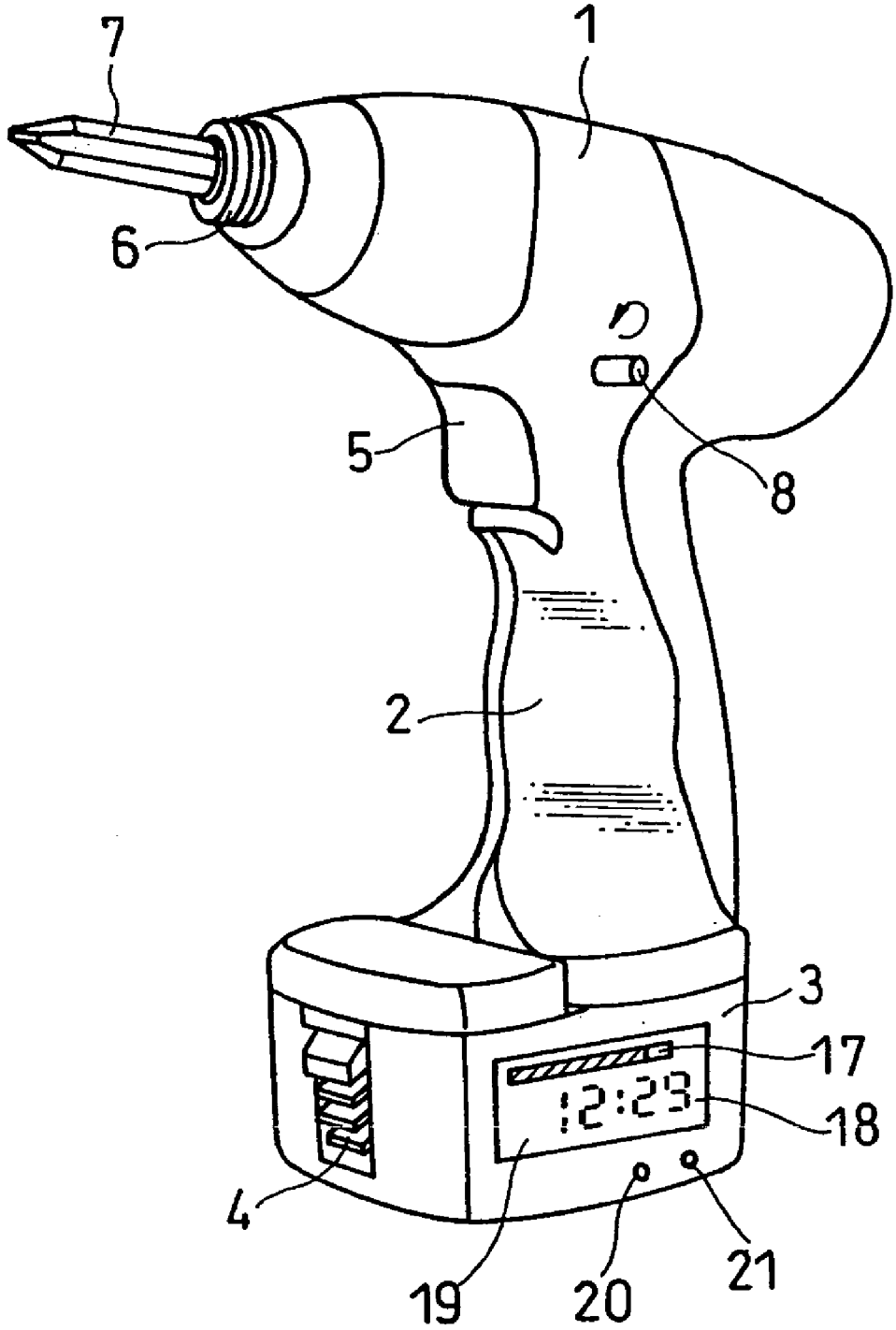
FIG. 4 is a schematic oblique view of an electric driver equipped with a display unit having a function of displaying the remaining power of a battery, and a clock function, in accordance with Embodiment 4 of the present invention.

FIG. 4 shows an oblique view of an electric driver equipped with a display unit having a function of displaying the remaining power of a battery, as well as a clock function, in accordance with an embodiment of the present invention. In FIG. 4, elements with the same numeral signals as those elements in FIG. 1 have the same names and functions as those elements in FIG. 1.

In the present embodiment, in addition to the lithium-ion secondary battery, a circuit of detecting remaining battery power and a clock circuit are housed in the battery pack 3, and the side surface of the battery pack 3 is provided with a display unit 19 equipped with a remaining battery power display portion 17 and a clock display portion 18. The side surface is further equipped with time-setting 20 and an alarm-setting 21. This shows the time, and also when the lithium-ion secondary battery needs to be replaced.

The use of this display unit also enables the inhibition of the disadvantage of specific deterioration of the lithium-ion secondary battery during storage in a fully charged state, even when the electric driver is not used.

Figure 8:
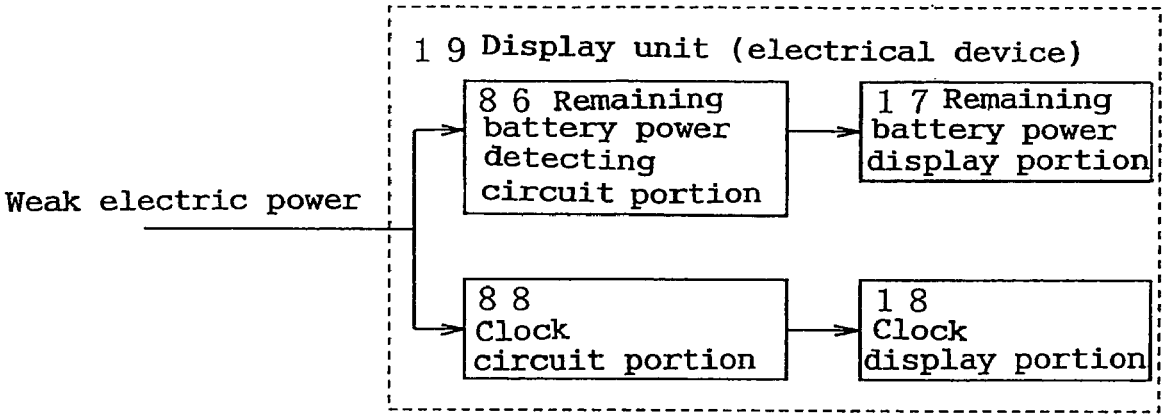
FIG. 8 is a schematic block diagram representing an example of a display unit as an electrical device, in accordance with Embodiment 4 of the present invention.

A constitutional example of electrical connection of an electric driver equipped with a display unit based on the present embodiment is one obtained by replacing the electrical device (radio) 54 in FIG. 5 with a display unit 19 as shown in the schematic block diagram in FIG. 8. Weak current power output in FIG. 8 corresponds to output from the small electric power output portion 53 in FIG. 5

In FIG. 8, the display unit 19 comprises: a remaining battery power detecting circuit portion 86 for detecting the remaining power of the lithium-ion secondary battery based on small electric power supplied from the lithium-ion secondary battery; a remaining battery power display portion 17 for displaying the remaining power of the battery, which is detected by the detecting circuit portion 86; a clock circuit portion 88 driven by small electric power supplied from the lithium-ion secondary battery; and a clock display portion 18 for displaying output of the clock circuit portion.

In the present embodiment, since the battery pack 3 is added with the display unit having a clock function comprising the clock circuit portion 88 and the clock display portion 18, the clock function, namely the display unit, can be used even when having been removed from the electric driver main body. In other words, the clock function, namely the display unit, can consume small electric power supplied from the lithium-ion secondary battery even when the battery pack 3 has been removed from the electric driver main body. This can inhibit the disadvantage of specific deterioration of the lithium-ion secondary battery during storage in a fully charged state.

Further, the aforesaid circuits (the remaining battery power detecting circuit portion 86 and clock circuit portion 88) operate on small electric power supplied from the lithium-ion secondary battery. This small electric power is in an amount ignorable as compared with electric power required for the rotation drive of the electric driver main body. Moreover, the lithium-ion secondary battery within the battery pack 3 is charged when its amount of electricity has decreased to a certain degree in order to normally drive the rotation drive. This can produce the following effect: For example, in the case where a display unit including a battery as an independent power source is not electrically connected to the battery pack 3, but simply installed therein mechanically, there are problems in that the power abruptly goes dead, or in that it takes all the trouble to replace the power supply just for activating the display unit. As opposed to this, the present embodiment has the effect of eliminating such problems.

It should be noted that, in the present embodiment, the display unit having a function of displaying the remaining power of a battery, as well as a clock function, is installed in the battery pack 3. It is thereby possible, as thus described, to obtain the effect generated by the integration of the lithium-ion secondary battery with the display unit even when the battery pack has been removed from the electric driver main body. When such an effect is not required, however, the display unit may be installed in the electric driver main body, such as the housing 1.

INDUSTRIAL APPLICABILITY

As thus described, according to the electric tool equipped with an additional function of the present invention, it is possible to utilize and take enjoyment in an additional function, such as a radio, while improving portability. It is further possible to inhibit specific deterioration peculiar to a lithium-ion secondary battery when the battery is stored in a fully charged state. Moreover, with the electrical device added, it becomes less likely that a tool is roughly used as a substitute for a hammer, which is under the ban in an instruction manual, thereby generating the effect of reducing the possibility that users of electric tools make complaints against manufactures thereof.

The invention claimed is:

1. An electric tool equipped with an additional function, said electric tool comprising a lithium-ion secondary battery to serve as a power supply and an electrical device which operates on small electric power supplied from said lithium-ion secondary battery, further comprising a battery pack including said lithium-ion secondary battery, said electrical device being installed integrally in said battery pack, wherein said electrical device continuously consumes said small electric power supplied from said lithium-ion secondary battery when said electrical device is electrically connected to said lithium-ion secondary battery, said electrical device is configured to be continuously electrically connected to said lithium-ion secondary battery within said battery pack so as to not include an electrical interrupter therebetween.

2. The electric tool equipped with an additional function in accordance with claim 1, wherein said electric tool is an electric driver.

3. The electric tool equipped with an additional function in accordance with claim 1, wherein said electrical device comprises a radio.

4. The electric tool equipped with an additional function in accordance with claim 3, wherein said electrical device comprises a clock.

5. The electric tool equipped with an additional function in accordance with claim 1, wherein said electrical device comprises a light.

6. The electric tool equipped with an additional function in accordance with claim 1, wherein said electrical device comprises a display unit.

7. The electric tool equipped with an additional function in accordance with claim 6, wherein said display unit has at least one of a function of displaying the remaining power of said lithium-ion secondary battery, and a clock function.

* * * * *